United States Patent [19]

Martini

[11] 4,432,364

[45] Feb. 21, 1984

[54] BRASSIERE

[75] Inventor: Jeanne M. Martini, Brooklyn, N.Y.

[73] Assignee: Consolidated Foods Corporation, Winston-Salem, N.C.

[21] Appl. No.: 494,341

[22] Filed: May 13, 1983

[51] Int. Cl.[3] ..... A41C 3/00

[52] U.S. Cl. ..... 128/484

[58] Field of Search ..... 128/484, 429, 494, 443, 128/489, 451, 499, 490

[56] References Cited

U.S. PATENT DOCUMENTS 3,362,409 1/1968 Burno ..... 128/494

3,957,057 5/1976 Farino ..... 128/498

*Primary Examiner*—Doris L. Troutman

*Attorney, Agent, or Firm*—Charles Y. Lackey; William S. Burden

[57] ABSTRACT

A brassiere having breast cups of molded, three-dimensional, two-ply fabric, each cup terminating in an apex at the top. Elastic power net fabric panels extend from the outer marginal edges of the cups rearwardly and have conventional fasteners for securing the brassiere in encircling relation to the wearer. Front, upper portions of the panels extend upwardly above the apex of an adjacent cup and have secured thereto shoulder straps. A selected portion of each panel is of two-ply construction.

10 Claims, 5 Drawing Figures

BRASSIERE

BRIEF SUMMARY AND OBJECTS OF THE INVENTION

The present invention relates to a brassiere in which each of the cups is formed of two plies of fabric molded into the desired three-dimensional configuration. The plies preferably are secured to each other around the outer marginal edges only. A panel of elastic power net fabric extends upwardly, to a point substantially above the apex of the bra cup, and rearwardly to the back of a wearer. Selected portions of the panel may be of two-ply construction. A shoulder strap extends from the back of each panel to the forward portion thereof positioned above the cup apex. The band around the entire bottom of the brassiere and the shoulder straps are of wide, elastic material providing comfort and ease to a wearer. Also, the width and construction of the panels provide control and comfort.

One of the primary objects of the invention is the provision of a brassiere construction which provides attractive and comfortable support to a awearer.

Another object of the invention is the provision of a brassiere construction wherein the forward portions of the shoulder straps are secured to the panels in spaced relation to the cups.

A further object of the invention is the provision of a brassiere construction providing firm cup support and panel reinforcement for control.

Other objects and advantages of the invention will become apparent when considered in view of the following detailed description.

DETAILED DESCRIPTION OF THE INVENTION

Figure 1:
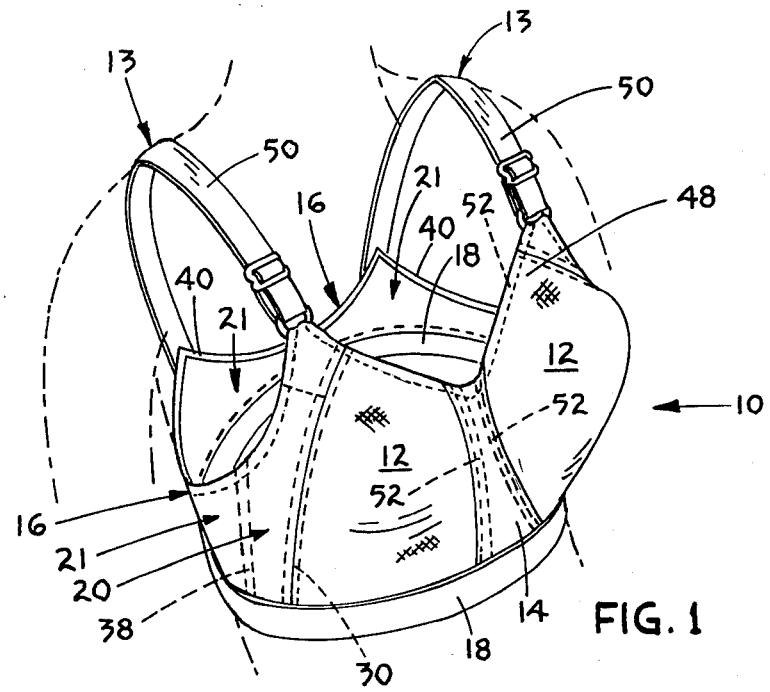
FIG. 1 is a fragmentary, perspective view of one embodiment of the brassiere of the present invention illustrating the structure in use on the body of a wearer.

Referring to the drawing, the brassiere 10 includes molded, three-dimensional breast cups generally indicated at 12, panels 16 which extend around the sides and back of a wearer, and adjustable shoulder strap assemblies 13. The breast cups 12 are secured to a central panel 14 positioned intermediate the cups. The outer portion of each cup is connected by stitching to a relatively wide panel 16 which extends around the side and back of a wearer. The free ends of the panels 16 have appropriate adjustable terminal fasteners which enable them to be secured to each other to hold the brassiere in place on the body of a wearer. A wide elastic band or tape 18 extends around and is secured to the entire bottom edges of the cups 12, panels 16 and central panel 14. The elastic band 18 and panels 16 are adapted to yield to adjust to the body contours of the wearer.

Figure 4:
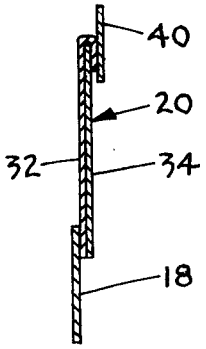
FIG. 4 is an enlarged, sectional view of another portion of the panel, taken along line 4—4 of FIG. 2.
Figure 5:
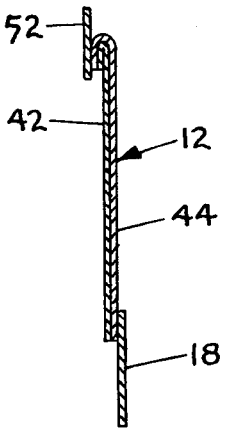
FIG. 5 is an enlarged, sectional view of a cup, taken along line 5—5 of FIG. 2.

Each of the panels 16 includes two sections 20 and 21. The section 20 has a marginal edge 22 conforming to the outer marginal edge 24 of a cup 12, and an upper portion 26 coupled to a strap assembly 13 by means of a ring 28 or other suitable means. The abutting marginal edges 22, 24 of the panel section 20 and the cup 12 are secured together by a tape binding 30 stitched thereto. The section 20 includes two plies of fabric 32, 34, as shown by FIG. 4, and each preferably is an elasticized power net construction to provide reinforcement and control.

The panel section 21 includes a single ply of elastic fabric 36 of a construction preferably corresponding to that of fabric plies 32 or 34. A vertically extending tape 38 is stitched on the inside portion of the brassiere at the juncture of panel sections 20 and 21. The tape 38 may be provided with a vertical, slightly resilient stay secured therein by stitching, if so desired. Also, the fabric 36 may be a discrete ply, or of a fabric integral with either of fabric plies 32 or 34.

An elastic binding tape 40 extends along the upper edges of the sections 20 and 21 from the ring fasteners 28 to an area adjacent the free ends of panels 16 having the terminal fasteners.

Figure 2:
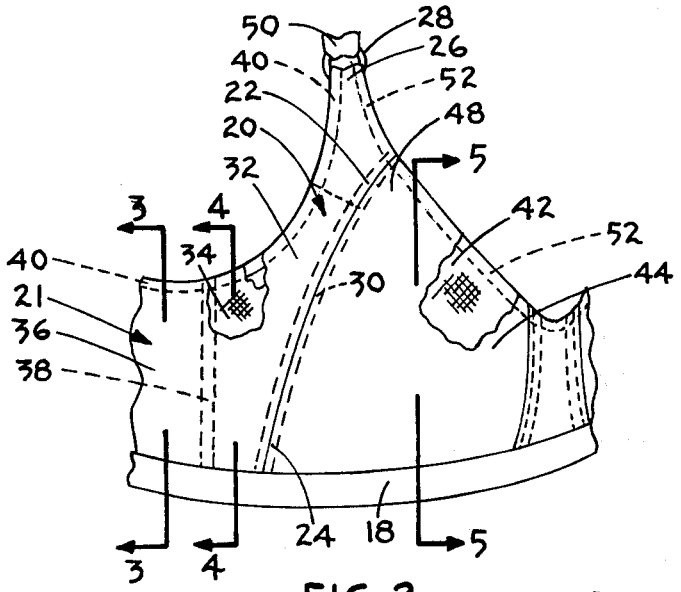
FIG. 2 is an enlarged, fragmentary, outer perspective view of the left breast cup and panel, with portions broken away.
Figure 3:
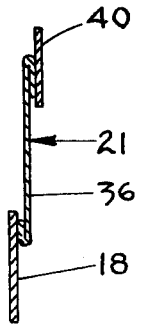
FIG. 3 is an enlarged, sectional view of one portion of the panel, taken along line 3—3 of FIG. 2.

Each cup 12 is of two-ply molded fabric construction to provide firm support. As shown by FIG. 2, the inner fabric ply 42 and the outer fabric ply 44 may be of substantially identical size, contour and construction. The two plies of material, which may be of various selected fabrics, are secured to each other only around the marginal edges. The outer marginal edges 24 of the two cups 12 extend upwardly from the band 18 and converge toward each other. Nonelastic tape binding 52 extends along the juncture of the cups 12 with the central panel 14, along the upper portions of cups 12, and continues along panel section 20 to the rings 28.

Note that the apex 48 of each cup is not attached to an adjacent strap assembly 13 but is maintained in spaced relation thereto by the double ply panel section 20 consisting of power net fabric. Thus the shoulder strap assemblies 13 are attached, both in the front and in the back, to panels 16 formed of elastic power net construction. The straps 50 preferably are of wide, stretch fabric providing comfort and ease to a wearer.

What is claimed is:

1. A brassiere construction comprising a pair of individual breast-receiving cups, each terminating in an apex at the top, means joining together said breast cups, a pair of panel means connected respectively to outer marginal edges of the breast cups for securing the brassiere in encircling relation to a wearer, each of said panel means including a first section secured to an adjacent breast cup and a second section extending around the side and to the back of a wearer, a pair of shoulder strap assemblies directly connected respectively to said pair of panel means, each shoulder strap assembly having a first portion coupled to said panel means first section adjacent a breast cup and a second portion attached to said panel means second section.

2. A brassiere construction as recited in claim 1, wherein each said breast cup is formed of two plies of fabric, said plies being secured together adjacent the marginal edges with the remaining portions being independent and capable of free movement relative to each other.

3. A brassiere construction as recited in claim 1, said panel means first section including two plies of elastic fabric.

4. A brassiere construction as recited in claim 1, said panel means first section including a first portion extending to a location substantially above the apex of an adjacent breast cup for coupling of said first portion of a shoulder strap assembly thereto.

5. A brassiere construction as recited in claim 1, said shoulder strap assemblies including relatively wide straps of elastic material, said panel means first and second sections being formed of elastic, power net construction, and further including a relatively wide band of elastic material secured to the lower portions of said breast cups and said pair of panel means.

6. A brassiere construction comprising a pair of breast cups, each terminating in an apex at the top, means joining said cups along the inner marginal edges thereof, a pair of panel means connected respectively to the outer marginal edges of said cups, each of said panel means including a first section having marginal edges secured to outer marginal edges of an independent cup and a portion extending vertically to a location above the apex of the adjacent cup, and a pair of shoulder strap assemblies directly connected respectively to said pair of panel means.

7. A brassiere construction as recited in claim 6, each of said panel means further including a second section, said first and second sections being elastic, power net construction.

8. A brassiere construction as recited in claim 7, said first section including two plies of elastic fabric.

9. A brassiere construction comprising a pair of molded, three-dimensional breast cups of multi-ply, nonelastic fabric construction, the plies being secured together adjacent the marginal edges thereof with the remaining portions being independent and capable of free movement relative to each other, central panel means secured to the inner marginal edges of said cups and maintaining said cups in spaced relation, a pair of panel means connected to the outer marginal edges of said cups and extending along the sides and back of a wearer, each of said pair of panel means including a first elastic fabric ply extending from a breast cup to the back of a wearer, and a second elastic fabric ply overlapping prescribed portions of said first elastic fabric ply and selectively secured to said first elastic fabric ply, and shoulder strap means connected to said pair of panel means.

10. A brassiere construction as recited in claim 9, said first elastic fabric ply having a portion extending upwardly above the uppermost marginal edge of an adjacent breast cup.

* * * * *